US005357646A

United States Patent [19]

Kim

[11] Patent Number: 5,357,646

[45] Date of Patent: Oct. 25, 1994

[54] HEATED ICE SCRAPER

[76] Inventor: David H. J. Kim, 88 Charles St. E. Apt. 202, Toronto, Ontario, Canada, M4Y 2W7

[21] Appl. No.: 71,854

[22] Filed: Jun. 7, 1993

[51] Int. Cl.[5] ..... A47L 1/06; A47L 13/08

[52] U.S. Cl. ..... 15/111; 15/236.02

[58] Field of Search ..... 15/111, 236.01, 236.02; 219/228, 229, 233, 236, 237

[56] References Cited

U.S. PATENT DOCUMENTS

| | | | |
|---|---|---|---|
| 2,700,096 | 1/1955 | Clements | 219/228 |
| 2,719,905 | 10/1955 | Lootens | 219/228 |
| 3,017,649 | 1/1962 | Racicot | 15/111 |
| 3,051,975 | 9/1962 | Schwartz | 15/111 |
| 3,711,679 | 1/1973 | Moschkau | 15/236.02 |
| 3,935,425 | 1/1976 | Weissberger | 15/236.02 |
| 4,034,489 | 7/1977 | Hughes | 219/228 |
| 4,809,386 | 3/1989 | Re | 15/111 |
| 5,072,486 | 12/1991 | Guarascio | 15/236.01 |
| 5,189,756 | 3/1993 | Sprunger | 15/236.01 |

FOREIGN PATENT DOCUMENTS

| | | | |
|---|---|---|---|
| 2617106 | 6/1987 | Fed. Rep. of Germany | 15/236.02 |

*Primary Examiner*—David A. Scherbel
*Assistant Examiner*—Terrence R. Till
*Attorney, Agent, or Firm*—Hugh E. Smith

[57] ABSTRACT

A hand-held ice scraper having a wide thin scraper blade at one end thereof and means within said scraper to electrically heat the peripheral edges of the ice-engaging surface of said scraper blade to assist in loosening ice to be removed thereby. A brush element is removably secured to the other end to also assist in cleaning the surface being worked upon.

2 Claims, 3 Drawing Sheets

HEATED ICE SCRAPER

BACKGROUND OF THE INVENTION

1. Field of the Invention

The present invention relates to ice scrapers and more particularly pertains to such scrapers which may be are electrically heated.

2. Description of the Prior Art

The use of heated blade ice scrapers is known in the prior art. More specifically, such scrapers heretofore devised and utilized for the purpose of removing ice are known to consist basically of familiar, expected and obvious structural configurations, notwithstanding the myriad of designs encompassed by the crowded prior art which have been developed for the fulfillment of countless objectives and requirements. Generally they have been constructed for use on sidewalks, highways, and the like, for example, U.S. Pat. Nos. 4,930,176. Other types of hand scrapers are shown in U.S. Pat. Nos. 4,719,660; 4,164,801 and U.S. Pat. No. 292,532.

In this respect, the ice scraper according to the present invention substantially departs from the conventional concepts and designs of the prior art, and in so doing provides an apparatus primarily developed for the purpose of being hand-held and applied to a surface such as an automobile windshield.

Therefore, it can be appreciated that there exists a continuing need for new and improved heated ice scrapers which can be hand-held. In this regard, the present invention substantially fulfills this need.

SUMMARY OF THE INVENTION

In view of the foregoing disadvantages inherent in the known types of ice scrapers now present in the prior art, the present invention provides an improved hand-held, ice scraper construction wherein the same can be utilized for windshields or the like. As such, the general purpose of the present invention, which will be described subsequently in greater detail, is to provide a new and improved heated ice scraper which has all the advantages of the prior art scrapers and none of the disadvantages.

To attain this, the present invention essentially comprises a hand-held ice scraper having a wide thin scraper blade at one end thereof and means within said scraper to electrically heat the peripheral edges of the ice-engaging surface of said scraper blade to assist in loosening ice to be removed thereby. A brush element is removably secured to the other end to also assist in cleaning the surface being worked upon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ice scraper which has all the advantages of the prior art ice scrapers and none of the disadvantages.

It is another object of the present invention to provide a new and improved heated ice scraper which may be easily and efficiently manufactured and marketed.

It is a further object of the present invention to provide a new and improved hand-held ice scraper which is of a durable and reliable construction.

An even further object of the present invention is to provide a new and improved heated ice scraper which is susceptible of a low cost of manufacture with regard to both materials and labor, and which accordingly is then susceptible of low prices of sale to the consuming public, thereby making such scrapers economically available to the buying public.

Still another object of the present invention is to provide a new and improved hand-held heated blade ice scraper.

Yet another object of the present invention is to provide a new and improved ice scraper which has a removable brush as a component thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
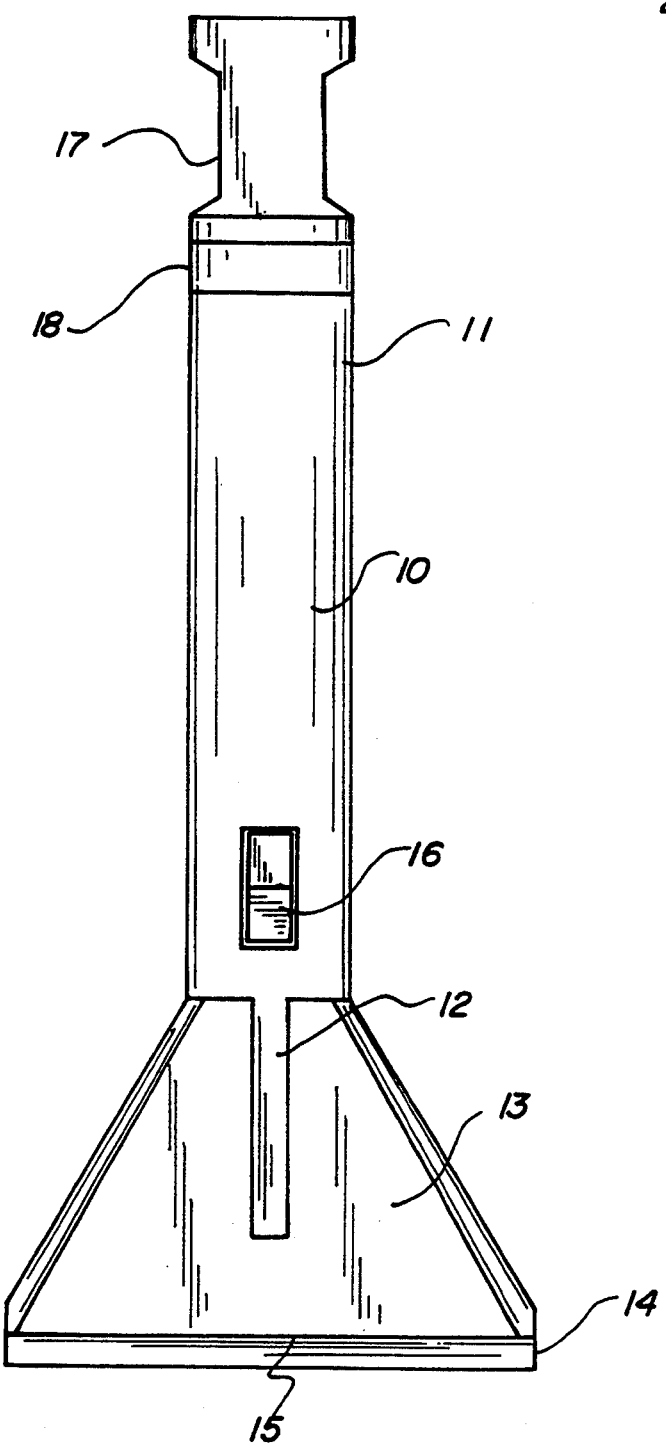
FIG. 1 is a top plan view of the device of the present invention.
Figure 2:
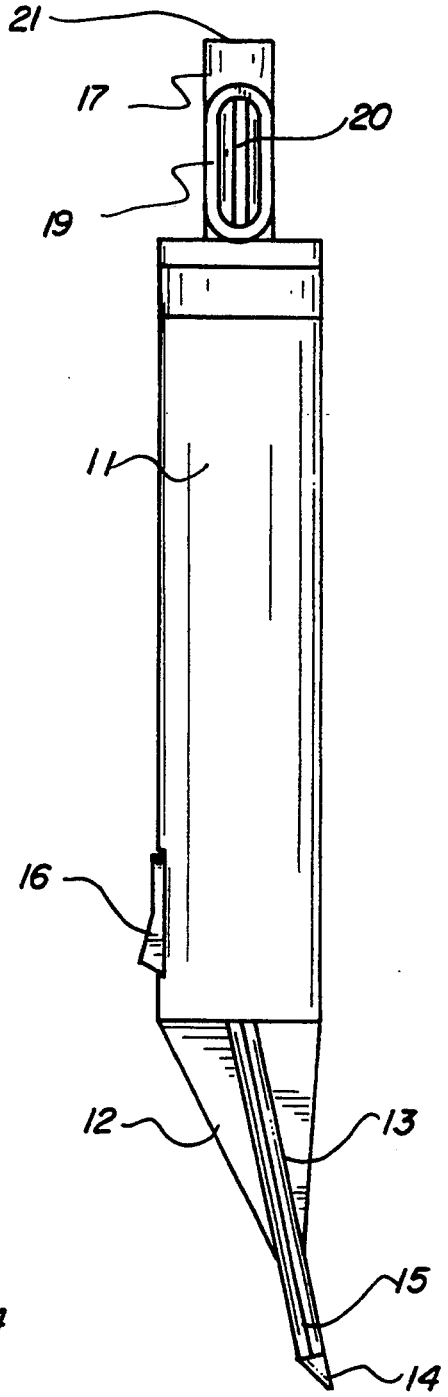
FIG. 2 is a side plan view of the device in FIG. 1.

With reference now to the drawings, and in particular to FIG. 1 and 2 thereof, a new and improved ice scraper embodying the principles and concepts of the present invention and generally designated by the reference numeral 10 will be described.

More specifically, it will be noted that the unit 10 consists of a main tubular body portion 11 of a diameter such as to easily be held in the hand of the user. One end of such body portion 11 terminates in a tapered housing 12 which reinforces and holds a thin, angular blade member 13 terminating in a wedge-shaped scraper blade 14. Embedded within the material (preferably a high-heat resistant plastic or ceramic) of the blade member 13 adjacent the outer peripheral edges thereof is a resistance wire 15. Such wire 15 is capable of being electrically heated, as illustrated hereinafter, with switch 16 being used to actuate the same. The other end of body portion 11 has an adaptor receiving receptacle 17 thereon. This receptacle 17 is mounted on a threaded cap member 18 which, when unthreaded from body portion 11 provides access to the interior of such body portion 11 for insertion and removal of batteries therefrom. Receptacle 17 has a recess 19 in each side thereof and within each such recess 19 a slot 20 communicating with the hollow interior 21 of receptacle 17 for purposes described in connection with FIG. 5 below.

Figure 3:
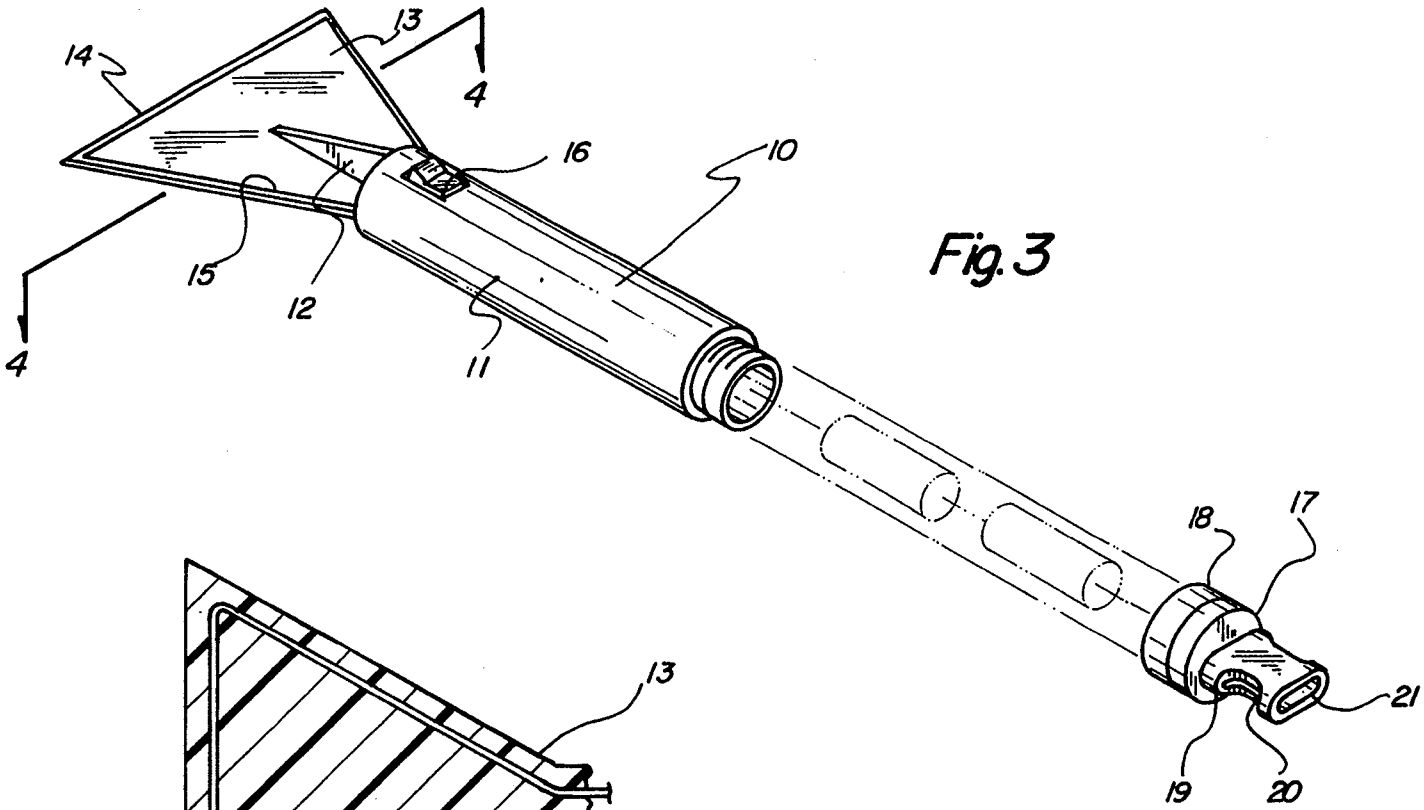
FIG. 3 is a partially exploded perspective view of the device of FIG. 1.

Referring now to FIG. 3 the unit 10 is shown in perspective with cap member 18 and receptacle 17 removed from tubular body 11. The batteries used to heat resistance wire 15 are shown in broken lines indicating the manner of inserting and removing the same from body 11.

Figure 4:
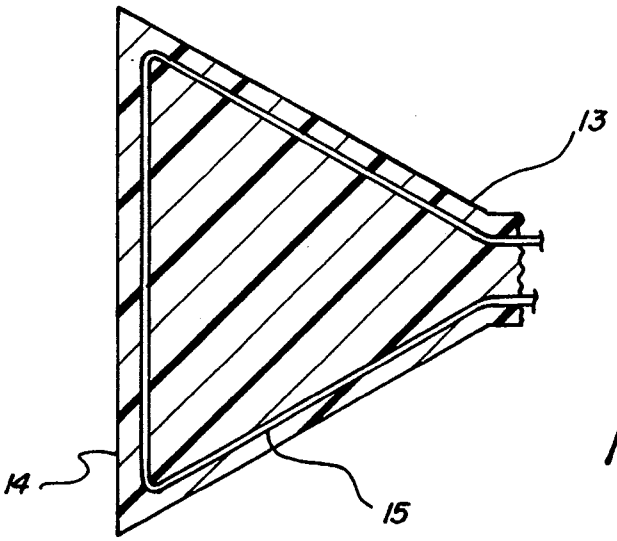
FIG. 4 is an enlarged, sectional view on line 4—4 of FIG. 3.

FIG. 4 illustrates resistance wire 15 embedded in blade member 13.

Figure 5:
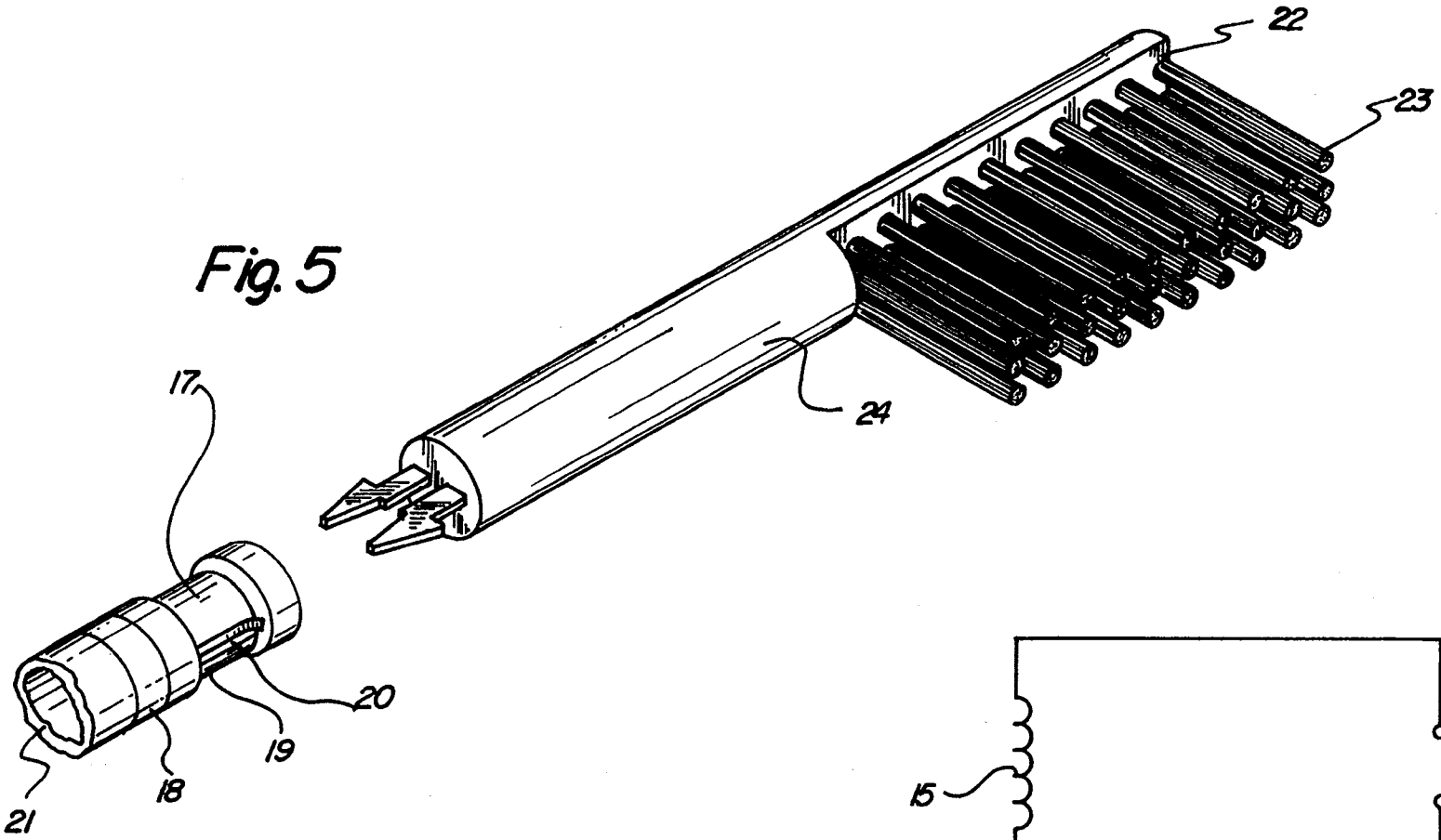
FIG. 5 is a partially exploded perspective view of a brush accessory for the device of FIG. 1.

FIG. 5 shows the accessory brush member 22 having a plurality of bristle 23 extending from a handle member 24. Brush member 22 engages with tubular body 11 of the scraper 10 by a pair of resilient clips 25 which are adapted to enter the open end 21 of receptacle 17 and to snap into slots 20 within the recesses 19 of receptacle 17.

Figure 6:
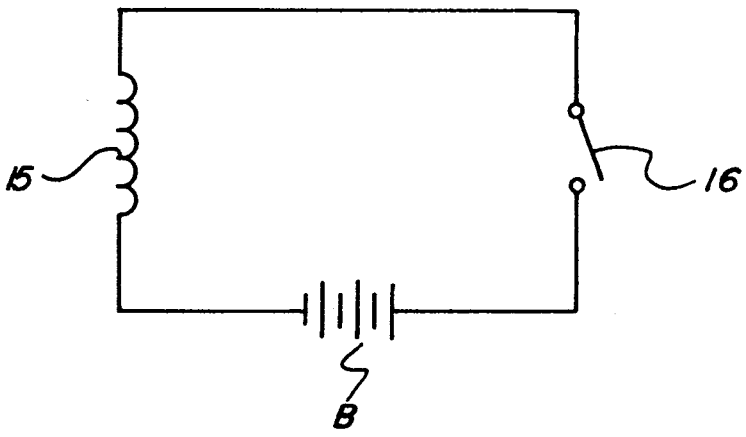
FIG. 6 is an electrical schematic of the heating means forming a component of the device of this invention.

FIG. 6 is a simple schematic showing the batteries "B" connected in series with resistance wire 15 and using switch 16 to make or break the circuit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A heated ice scraper comprising:

an elongated, hollow, tubular body portion for receiving a plurality of batteries therewithin, said body portion having a first end and a second end, with a tapered housing extending from said first end and threads circumscribing said second end;

a threaded cap member threadably engaged to said threads circumscribing said second end of said tubular body portion, said cap being operable to removably capture said batteries within said tubular body portion;

a blade member having an outer periphery and a forward edge, with a scraper blade formed in said forward edge for scraping ice from a surface, said blade member being received within and mounted to said tapered housing of said body portion;

a resistance wire embedded within said blade member and extending around said blade member proximate said periphery and said scraper blade, said resistance wire being operable to generate heat upon energization thereof for melting ice in contact with said blade member;

a switch electrically connectable to said plurality of batteries for selectively energizing said resistance wire;

a receptacle fixedly secured to said threaded cap member;

a handle member having a handle member first end and a handle member second end;

a brush member having a plurality of bristles extending therefrom, said brush member being coupled to said handle member second end; and, means for removably coupling said handle member first end to said receptacle.

2. A heated ice scraper comprising:

an elongated, hollow, tubular body portion for receiving a plurality of batteries therewithin, said body portion having a first end and a second end, with a tapered housing extending from said first end and threads circumscribing said second end;

a threaded cap member threadably engaged to said threads circumscribing said second end of said tubular body portion, said cap being operable to removably capture said batteries within said tubular body portion;

a blade member having an outer periphery and a forward edge, with a scraper blade formed in said forward edge for scraping ice from a surface, said blade member being received within and mounted to said tapered housing of said body portion;

a resistance wire embedded within said blade member and extending around said blade member proximate said periphery and said scraper blade, said resistance wire being operable to generate heat upon energization thereof for melting ice in contact with said blade member;

a switch electrically connectable to said plurality of batteries for selectively energizing said resistance wire;

a receptacle fixedly secured to said threaded cap member, said receptacle having an exterior and a substantially hollow interior with a pair of diametrically opposed recess formed upon said exterior, with each of said recesses having a slot directed therethrough into communication with said hollow interior;

a handle member having a handle member first end and a handle member second end;

a brush member having a plurality of bristles extending therefrom, said brush member being coupled to said handle member second end; and, means for removably coupling said handle member first end to said receptacle, said means for removably coupling said handle member to said receptacle comprising a pair of resilient clips coupled to said handle member first end, said clips lying in a common plane and being operable to enter said hollow interior and snap into said slots of said receptacle.

* * * * *